US011735382B1

(12) United States Patent
Lai et al.

(10) Patent No.: US 11,735,382 B1
(45) Date of Patent: Aug. 22, 2023

(54) KEYBOARD DEVICE

(71) Applicant: Primax Electronics Ltd., Taipei (TW)

(72) Inventors: Zheng-Hong Lai, Taipei (TW); Che-Wei Lee, Taipei (TW); Chin-Lung Chan, Taipei (TW); Chih-Ho Hsu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/957,703

(22) Filed: Sep. 30, 2022

(30) Foreign Application Priority Data

Aug. 26, 2022 (TW) ..... 111132360

(51) Int. Cl.

| | |
|---|---|
| ***H01H 3/12*** | (2006.01) |
| ***H01H 13/7065*** | (2006.01) |
| ***H01H 13/04*** | (2006.01) |
| ***H01H 13/704*** | (2006.01) |

(52) U.S. Cl.
CPC ..... *H01H 13/7065* (2013.01); *H01H 3/125* (2013.01); *H01H 13/04* (2013.01); *H01H 13/704* (2013.01); *H01H 2233/04* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 10,755,877 | B1 * | 8/2020 | Wang | H03K 17/9629 |
| 10,784,062 | B2 * | 9/2020 | Wang | G06F 1/1656 |
| 2017/0345589 | A1 * | 11/2017 | Wu | H01H 13/785 |
| 2022/0384126 | A1 * | 12/2022 | Chen | H01H 13/83 |

* cited by examiner

*Primary Examiner* — Ahmed M Saeed
(74) *Attorney, Agent, or Firm* — Evan R. Witt

(57) ABSTRACT

A keyboard device includes a base plate, a plurality of key structures, a floating frame and a cover layer. The key structures are disposed over the base plate, and each of the key structures has a keycap. The floating frame is disposed over and separated from the base plate. The floating frame has a plurality of openings, and the key structures are disposed in the openings, respectively. The cover layer covers the keycaps of the key structures and the floating frame and is in direct or indirect contact with an upper surface of the keycap of each of the key structures and an upper surface of the floating frame. When the keycap of one of the key structures and the cover layer thereover are pressed to bottom, the floating frame surrounding the one of the key structures is pulled by the cover layer and shifted.

11 Claims, 4 Drawing Sheets

KEYBOARD DEVICE

FIELD OF THE INVENTION

The present invention relates to a keyboard device, and more particularly, to a keyboard device having a cover layer.

BACKGROUND OF THE INVENTION

At present, there are keyboard devices having cover layers on the market, but they still have some disadvantages. For example, in a commercial product, the cover layer is only attached to a central region of an upper surface of a keycap and not attached to a peripheral region of the upper surface of the keycap and a fixed frame; however, when the keycap is pressed, the cover layer attached to the central region of the upper surface of the keycap moves down with the keycap, but the cover layer not attached to the peripheral region of the upper surface of the keycap does not completely move down with the keycap, so the central region of the cover layer is depressed, and the peripheral region of the cover layer is floating up, resulting in poor appearance of the cover layer.

SUMMARY OF THE INVENTION

The present disclosure provides a keyboard device, which includes a base plate, a plurality of key structures, a floating frame and a cover layer. The key structures are disposed over the base plate, and each of the key structures has a keycap. The floating frame is disposed over and separated from the base plate. The floating frame has a plurality of openings, and the key structures are disposed in the openings, respectively. The cover layer covers the keycaps of the key structures and the floating frame and is in direct or indirect contact with an upper surface of the keycap of each of the key structures and an upper surface of the floating frame. When the keycap of one of the key structures and the cover layer thereover are pressed to bottom, the floating frame surrounding the one of the key structures is pulled by the cover layer and shifted.

In some embodiments of the present disclosure, when the keycap of the one of the key structures is pressed to the bottom, the floating frame surrounding the one of the key structures is not in contact with the base plate.

In some embodiments of the present disclosure, a thickness of the floating frame is less than or equal to a key travel distance of each of the key structures.

In some embodiments of the present disclosure, a distance between the floating frame and the base plate is greater than or equal to a key travel distance of each of the key structures.

In some embodiments of the present disclosure, the key travel distance of each of the key structures is greater than or equal to 0.8 mm.

In some embodiments of the present disclosure, a thickness of the floating frame is less than or equal to a width of the floating frame between adjacent two of the key structures.

In some embodiments of the present disclosure, when the keycap of the one of the key structures is not pressed, a distance between the keycap of the one of the key structures and the floating frame is greater than or equal to a thickness of the floating frame.

In some embodiments of the present disclosure, the cover layer is adhered to the upper surface of the keycap and the upper surface of the floating frame through an adhesive layer.

In some embodiments of the present disclosure, the floating frame includes rigid plastic, glass fiber, carbon fiber, metal, elastic material, or a combination thereof.

In some embodiments of the present disclosure, the floating frame and the cover layer are made of the elastic material, and a thickness of the floating frame is greater than a thickness of the cover layer.

In some embodiments of the present disclosure, the floating frame is made of the elastic material, and the cover layer is made of another elastic material, and an initial elastic modulus of the elastic material of the floating frame within its elastic deformation range is greater than an initial elastic modulus of the other elastic material of the cover layer within its elastic deformation range.

In some embodiments of the present disclosure, the elastic material includes silicone, rubber, or a combination thereof.

BRIEF DESCRIPTION OF THE DRAWINGS

Aspects of the present disclosure are best understood from the following embodiments, read in conjunction with the accompanying drawings. It should be understood, however, that in accordance with common practice in the industry, various features have not necessarily been drawn to scale. Indeed, shapes of the various features may be suitably adjusted for clarity, and dimensions of the various features may be arbitrarily increased or decreased.

DETAIL DESCRIPTION OF THE PREFERRED EMBODIMENT

Figure 1:
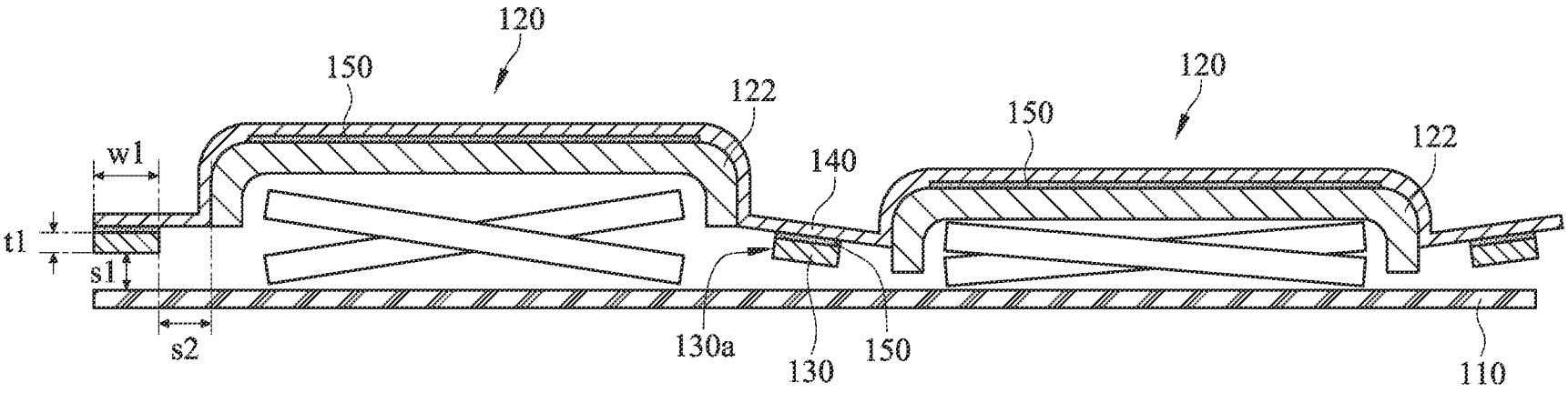
FIG. 1 is a schematic cross-sectional view of a keyboard device according to an embodiment of the present invention.

The advantages and features of the present disclosure and the method for achieving the same will be described in more detail with reference to exemplary embodiments and the accompanying drawings to make it easier to understand. However, the present disclosure can be implemented in different forms and should not be construed as being limited to the embodiments set forth herein. On the contrary, for those skilled in the art, the provided embodiments will make this disclosure more thorough, comprehensive and complete to convey the scope of the present disclosure.

The spatially relative terms in the text, such as "beneath" and "over", are used to facilitate the description of the relative relationship between one element or feature and another element or feature in the drawings. The true meaning of the spatially relative terms includes other orientations. For example, when the drawing is flipped up and down by 180 degrees, the relationship between the one element and the other element may change from "beneath" to "over." In addition, the spatially relative descriptions used herein should be interpreted the same.

As described in the related art, in the keyboard device having the cover layer on the market, when the keycap is pressed, the central region of the cover layer is depressed, and the peripheral region of the cover layer is floating up, resulting in poor appearance of the cover layer. Accordingly, the present invention provides a novel keyboard device to solve aforementioned problems. Various embodiments of the keyboard device of the present invention are described in detail below.

FIG. 1 is a schematic cross-sectional view of a keyboard device according to an embodiment of the present invention. As shown in FIG. 1, the keyboard device includes a base plate 110, a plurality of key structures 120 (two key structures 120 are taken as an example in FIG. 1), a floating frame 130 and a cover layer 140.

The key structures 120 are disposed over the base plate 110, and each of the key structures 120 has a keycap 122. In some embodiments, the key structure 120 further includes a scissor-type connecting element (not marked), but the present invention is not limited thereto. In other embodiments, the key structure may not include a scissor-type connecting element. In some embodiments, the key structure 120 further includes an elastic element (not shown), such as a rubber dome or a metal dome. In some embodiments, the keyboard device further includes a membrane circuit board (not shown), which may be disposed over the base plate 110.

The floating frame (also referred to as a movable frame) 130 is disposed over and separated from the base plate 110. The floating frame 130 is laterally adjacent to the key structure 120. The floating frame 130 has a plurality of openings 130*a*. The key structures 120 are respectively disposed in the openings 130*a* and separated from the floating frame 130. In some embodiments, when viewed from above, the floating frame 130 has a plurality of square and/or rectangular openings for accommodating the key structures 120, respectively. In some embodiments, the floating frame 130 is made of a rigid material. The term "rigid material" refers to a material that has poor deformation ability and is not easily deformed under stress. In some embodiments, the floating frame 130 includes rigid plastic, glass fiber, carbon fiber, metal, elastic material, or a combination thereof. The rigid plastic may be, for example, acrylonitrile butadiene styrene (ABS), polycarbonate (PC), polyethylene terephthalate (PET), but the present invention is not limited thereto. In some embodiments, the elastic material includes silicone, rubber, or a combination thereof, but the present invention is not limited thereto.

The cover layer 140 covers the keycaps 122 of the key structures 120 and the floating frame 130, and is in direct or indirect adhered to an upper surface of the keycap 122 of each of the key structures 120 and an upper surface of the floating frame 130. In some embodiments, the cover layer 140 is in direct or indirect adhered to the entire upper surface of the keycap 122 of each of the key structures 120. In some embodiments, the cover layer 140 is in direct or indirect adhered to the entire upper surface of the floating frame 130. In some embodiments, the cover layer 140 is made of the elastic material, such as polyurethane (PU), silicone or other suitable materials. In some embodiments, the aforementioned elastic material is not inherently viscous or is inherently viscous. In some embodiments, the cover layer 140 is made of the elastic material that is not inherently viscous, so the cover layer 140 is indirectly adhered to the upper surface of the keycap 122 and the upper surface of the floating frame 130 through an adhesive layer 150.

In some embodiments, the floating frame 130 is made of a material, and the cover layer 140 is made of an elastic material different from the material, and rigidity of the material of the floating frame 130 is greater than rigidity of the elastic material of the cover layer 140, so that the cover layer 140 can have good dimensional stability and stiffness.

In some embodiments, the floating frame 130 and the cover layer 140 are made of the same elastic material, and a thickness t1 of the floating frame 130 is greater than a thickness of the cover layer 140, so that the cover layer 140 can have good dimensional stability and stiffness.

In some embodiments, the floating frame 130 is made of an elastic material, and the cover layer 140 is made of another elastic material (i.e., the floating frame 130 and the cover layer 140 are made of different elastic materials), and an initial elastic modulus of the elastic material of the floating frame 130 in its elastic deformation range is greater than an initial elastic modulus of the other elastic material of the cover layer 140 in its elastic deformation range, so that the cover layer 140 can have good dimensional stability and stiffness.

In some embodiments, after the cover layer 140 is formed, due to material properties of the cover layer 140 itself, the cover layer 140 will gradually shrink, which may cause the cover layer 140 to be uneven and affect the pressing feel of the key structure 120; however, in the present disclosure, the floating frame 130 can help resist the shrinkage force of the cover layer 140 by selecting the material of the floating frame 130 and/or designing the thicknesses of the floating frame 130 and the cover layer 140, so that the cover layer 140 can be kept flat and has good dimensional stability and stiffness.

The action mechanism of the floating frame 130 of the present disclosure is described below. When the keycap 122 of one of the key structures 120 and the cover layer 140 thereover are pressed down to bottom (please refer to the right side of FIG. 1), the floating frame 130 surrounding the one of the key structures 120 is pulled by the cover layer 140 and displaced. In detail, the floating frame 130 close to the pressed keycap 122 is inclined downward since it is pulled by the cover layer 140. Therefore, when the keycap 122 is pressed down, the cover layer 140 over a peripheral region of the keycap 122 fails to float up, so that the cover layer 140 has a good appearance. In addition, the floating frame 130 is pulled by the cover layer 140 and inclined downward, which can reduce the influence of the cover layer 140 on the pressing feel of the key structure 120, so that the key structure 120 maintains the suitable pressing feel (e.g., paragraph sense). In some embodiments, when the keycap 122 of the one of the key structures 120 is pressed down to the bottom, the floating frame 130 surrounding the one of the key structures 120 is not in contact with the base plate 110 to avoid affecting the pressing feel of the user.

In some embodiments, the thickness t1 of the floating frame 130 is less than or equal to a key travel distance of each of the key structures 120. The thickness t1 may be, for example, 0.05 mm, 0.1 mm, 0.2 mm, 0.3 mm, 0.4 mm, 0.5 mm, 0.6 mm, 0.7 mm, 0.8 mm, 0.9 mm or 1.0 mm, but the present invention is not limited thereto.

In some embodiments, the distance s1 between the floating frame 130 (when the keycap 122 is not pressed) and the base plate 110 is greater than or equal to the key travel distance of each of the key structures 120. As such, when the keycap 122 moves down and the floating frame 130 is inclined downward accordingly, the floating frame 130 is not in contact with the base plate 110.

The key travel distance of the key structure 120, that is, the distance that the keycap 122 is pressed down from an original position to the bottom, preferably falls within an appropriate range to provide a good pressing feel. In some embodiments, the key travel distance of each of the key structures 120 of the keyboard device of a notebook is greater than 0.7 mm, or greater than or equal to 0.8 mm, such as 0.9 mm, 1.0 mm, 1.1 mm, 1.2 mm, 1.3 mm, 1.4 mm, 1.5 mm, 1.6 mm or 1.7 mm, but the present invention is not limited thereto.

In some embodiments, the thickness t1 of the floating frame 130 is less than or equal to a width w1 of the floating frame 130 between adjacent two of the key structures 120.

In some embodiments, when the keycap 122 of the one of the key structures 120 is not pressed, a spacing s2 between the keycap 122 of the one of the key structures 120 (e.g., an edge of the keycap 122) and the floating frame 130 is greater than or equal to the thickness t1 of the floating frame 130.

The cover layer 140 between the floating frame 130 and the keycap 122 shown in FIG. 1 is L-shaped, but the present invention is not limited thereto, and other embodiments of the keyboard devices are provided below.

Figure 2:
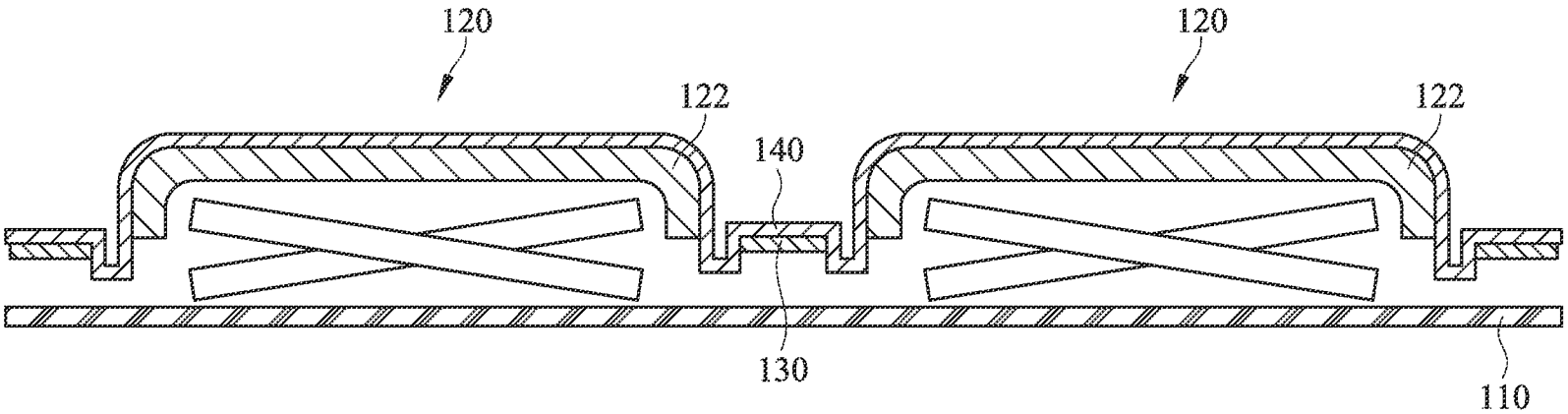
FIG. 2 is a schematic cross-sectional view of a keyboard device according to an embodiment of the present invention.

FIG. 2 is a schematic cross-sectional view of a keyboard device according to an embodiment of the present invention. As shown in FIG. 2, the cover layer 140 between the floating frame 130 and the keycap 122 is U-shaped, and extends to a position beneath a gap between the floating frame 130 and the keycap 122. In addition, in this embodiment, a bottom surface of an edge of the keycap 122 is substantially coplanar with a top surface of the floating frame 130.

Figure 3:
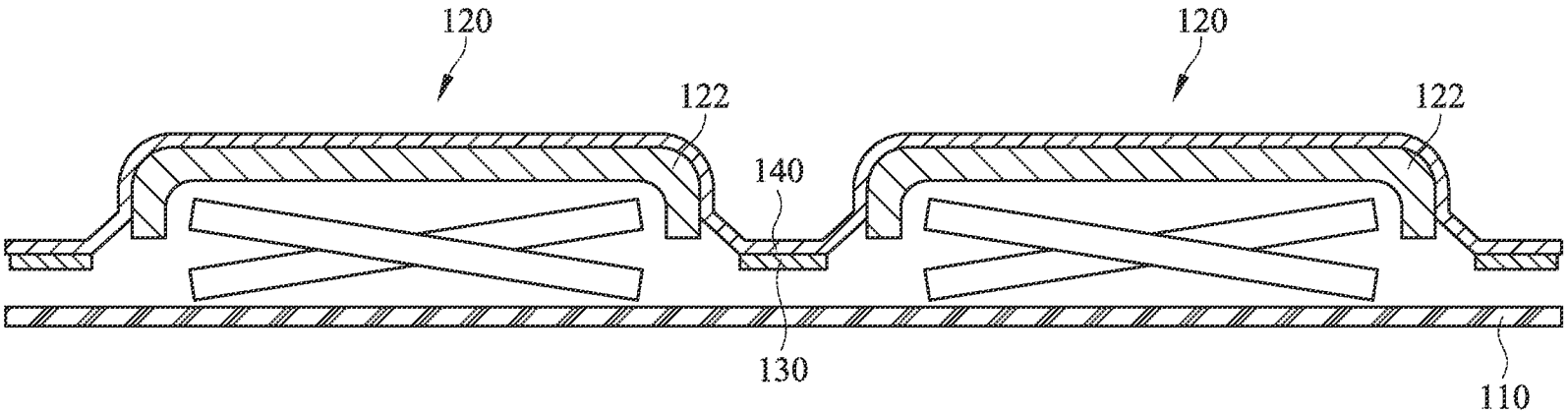
FIG. 3 is a schematic cross-sectional view of a keyboard device according to an embodiment of the present invention.

FIG. 3 is a schematic cross-sectional view of a keyboard device according to an embodiment of the present invention. As shown in FIG. 3, the cover layer 140 between the floating frame 130 and the keycap 122 is in the shape of an obtuse-angled polyline, and does not extend to a position beneath a gap between the floating frame 130 and the keycap 122. In addition, in this embodiment, a bottom surface of an edge of the keycap 122 is higher than a top surface of the floating frame 130.

Figure 4:
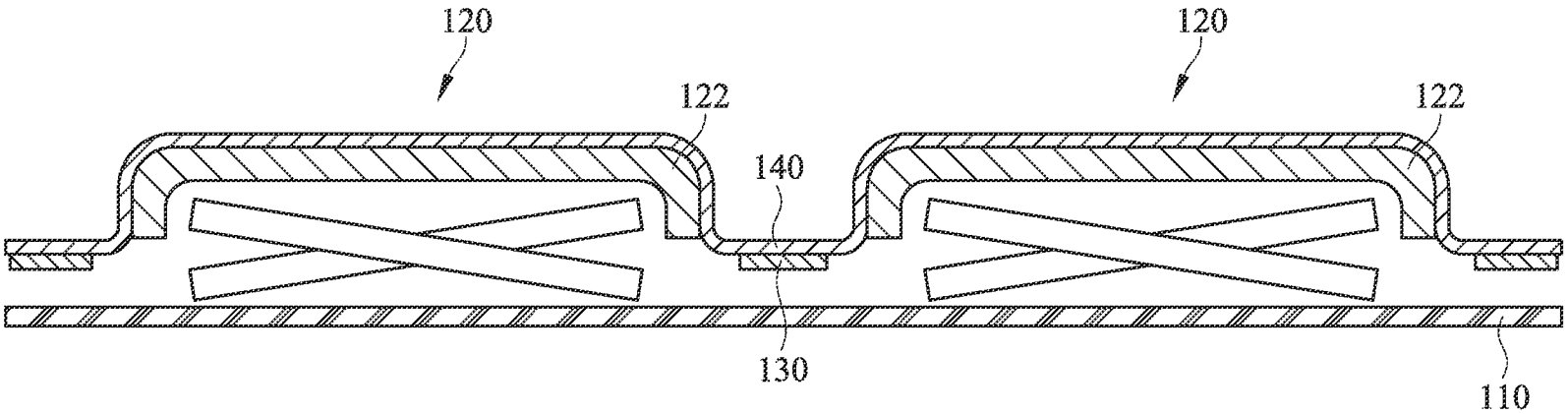
FIG. 4 is a schematic cross-sectional view of a keyboard device according to an embodiment of the present invention.

FIG. 4 is a schematic cross-sectional view of a keyboard device according to an embodiment of the present invention. As shown in FIG. 4, the cover layer 140 between the floating frame 130 and the keycap 122 is in an arc shape, and does not extend to a position beneath a gap between the floating frame 130 and the keycap 122. In addition, in this embodiment, a bottom surface of an edge of the keycap 122 is higher than a top surface of the floating frame 130.

The above-mentioned key travel distance of the key structure 120, the thickness t1 and the width w1 of the floating frame 130, the distance s1 between the floating frame 130 and the base plate 110, the spacing s2 between the keycap 122 and the floating frame 130, the shape and length of the cover layer 140 between the floating frame 130 and the keycap 122 (i.e. the length in the cross-sectional view), and the relative positions of the keycap 122 and the floating frame 130 can be adjusted appropriately to make the pressing feel of key structure 120 more in line with the needs of users.

However, the above are only the preferred embodiments of the present disclosure, and should not be used to limit the scope of implementation of the present disclosure, that is, simple equivalent changes and modifications made in accordance with claims and description of the present disclosure are still within the scope of the present disclosure. In addition, any embodiment of the present disclosure or claim does not need to achieve all the objectives or advantages disclosed in the present disclosure. In addition, the abstract and the title are not used to limit the scope of claims of the present disclosure.

What is claimed is:

1. A keyboard device, comprising: a base plate; a plurality of key structures disposed over the base plate, each of the key structures having a keycap; a floating frame disposed over and separated from the base plate, the floating frame having a plurality of openings, and the key structures being disposed in the openings, respectively; and a cover layer covering the keycaps of the key structures and the floating frame, and in direct contact with an upper surface of the keycap of each of the key structures and an upper surface of the floating frame, wherein when the keycap of one of the key structures and the cover layer thereover are pressed down to bottom, the floating frame surrounding the one of the key structures is pulled by the cover layer and shifted, wherein when the keycap of the one of the key structures is pressed to the bottom, the floating frame surrounding the one of the key structures is not in contact with the base plate.

2. The keyboard device of claim 1, wherein a thickness of the floating frame is less than or equal to a key travel distance of each of the key structures.

3. The keyboard device of claim 1, wherein a distance between the floating frame and the base plate is greater than or equal to a key travel distance of each of the key structures.

4. The keyboard device of claim 3, wherein the key travel distance of each of the key structures is greater than or equal to 0.8 mm.

5. The keyboard device of claim 1, wherein a thickness of the floating frame is less than or equal to a width of the floating frame between adjacent two of the key structures.

6. The keyboard device of claim 1, wherein when the keycap of the one of the key structures is not pressed, a distance between the keycap of the one of the key structures and the floating frame is greater than or equal to a thickness of the floating frame.

7. The keyboard device of claim 1, wherein the cover layer is adhered to the upper surface of the keycap and the upper surface of the floating frame through an adhesive layer.

8. The keyboard device of claim 1, wherein the floating frame comprises rigid plastic, glass fiber, carbon fiber, metal, elastic material, or a combination thereof.

9. The keyboard device of claim 8, wherein the floating frame and the cover layer are made of the elastic material, and a thickness of the floating frame is greater than a thickness of the cover layer.

10. The keyboard device of claim 8, wherein the floating frame is made of the elastic material, and the cover layer is made of another elastic material, and an initial elastic modulus of the elastic material of the floating frame within its elastic deformation range is greater than an initial elastic modulus of the other elastic material of the cover layer within its elastic deformation range.

11. The keyboard device of claim 8, wherein the elastic material comprises silicone, rubber, or a combination thereof.

* * * * *